United States Patent [19]

Stoddard

[11] 4,361,241

[45] Nov. 30, 1982

[54] HANGER SUPPORT

[75] Inventor: David C. F. Stoddard, Atlanta, Ga.

[73] Assignee: Abrams Fixture Corporation, Atlanta, Ga.

[21] Appl. No.: 94,118

[22] Filed: Nov. 14, 1979

[51] Int. Cl.[3] ..... A47F 7/16

[52] U.S. Cl. ..... 211/123; 211/45; D6/257

[58] Field of Search ..... 211/45, 105.1, 123, 211/206, 193, 204; D6/257, 188, 125, 116

[56] References Cited

U.S. PATENT DOCUMENTS

| | | | |
|---|---|---|---|
| 219,713 | 9/1879 | Goodyear . | |
| D. 247,085 | 1/1978 | Stoddard | D6/257 |
| 878,271 | 2/1908 | Blackford . | |
| 1,068,050 | 7/1913 | Gardner et al. . | |
| 1,095,006 | 5/1914 | Lowe . | |
| 1,228,556 | 6/1917 | Hesse . | |
| 1,243,741 | 10/1917 | Jakab . | |
| 1,482,649 | 2/1924 | Hayden . | |
| 1,639,729 | 8/1927 | Hill . | |
| 1,991,156 | 2/1935 | Kahn et al. | 211/45 |
| 2,007,496 | 7/1935 | Hurlbut | 211/125 |
| 2,089,370 | 8/1937 | Heinrich et al. | 248/65 |
| 2,438,324 | 3/1948 | Pfeffer | 211/177 |
| 2,655,296 | 10/1953 | Winzer | 223/88 |
| 2,671,566 | 3/1954 | Levy, Jr. | 211/45 |
| 2,777,624 | 1/1957 | Nelson | 224/42.1 |
| 2,868,389 | 1/1959 | Friend | 211/123 |
| 2,895,618 | 7/1959 | Nathan | 211/123 |
| 2,912,149 | 11/1959 | Stuard | 223/92 |
| 2,920,766 | 1/1960 | Ivan | 211/123 |
| 2,946,454 | 7/1960 | Asher | 211/45 |
| 3,008,248 | 9/1961 | Steinthal | 35/55 |
| 3,070,269 | 12/1962 | Zuckerman | 223/88 |
| 3,235,095 | 2/1966 | Neill | 211/113 |
| 3,384,244 | 5/1968 | Falek | 211/123 |
| 3,435,955 | 4/1969 | Brunette | 211/24 |
| 3,481,483 | 12/1969 | Harvey et al. | 211/105.3 |
| 3,698,607 | 10/1972 | Batts | 223/96 |
| 3,767,092 | 10/1973 | Garrison | 223/96 |
| 3,871,524 | 3/1975 | Helf | 211/45 |
| 3,913,498 | 10/1975 | Hall et al. | 108/111 |
| 3,965,583 | 6/1976 | Price | 35/55 |
| 3,984,002 | 10/1976 | Howard | 211/45 |
| 3,991,884 | 9/1976 | DeMaagd et al. | 211/1.5 |
| 4,004,501 | 1/1977 | Guerrero | 99/426 |

FOREIGN PATENT DOCUMENTS

| | | |
|---|---|---|
| 114130 | 9/1941 | Australia . |

*Primary Examiner*—Roy D. Frazier
*Assistant Examiner*—Robert W. Gibson, Jr.
*Attorney, Agent, or Firm*—George M. Thomas

[57] ABSTRACT

A hanger strip is mounted on a rectilinear tubular hanger bar and includes a series of equally spaced duplicate projections longitudinally aligned along the strip which define a series of duplicate recesses therebetween for receiving the curved hooks of hangers. The recesses are oriented parallel to one another and at an angle other than a right angle with respect to the length of the strip so that the hooks of the hangers supported in the recesses are oriented parallel to one another and skewed at an acute angle with respect to the length of the strip. When the hanger bar is oriented in an inclined attitude, the strip is positioned slightly to one side of the upper surface of the hanger bar so that the two support areas of each recess of the strip are level with each other.

4 Claims, 6 Drawing Figures

Fig. 4
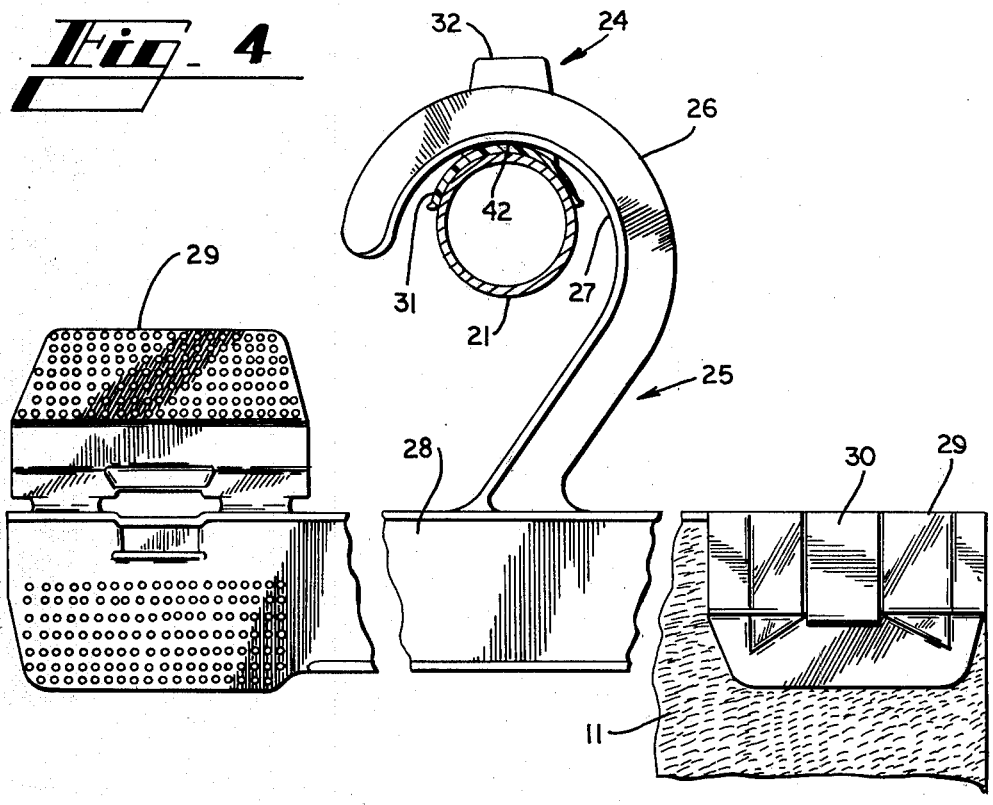
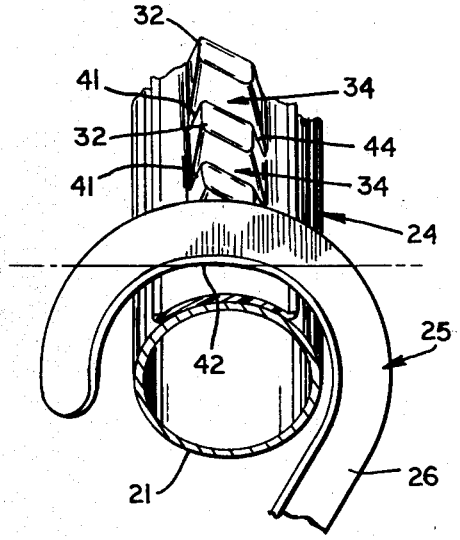
Fig. 5
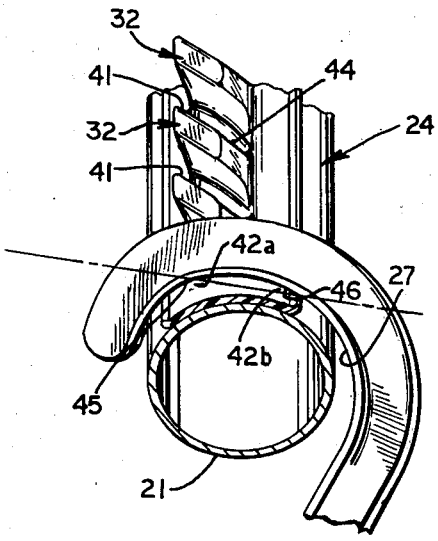
Fig. 6

HANGER SUPPORT

FIELD OF INVENTION

This invention relates to hanger supports for displaying carpet samples and other items in an attractive, uniform arrangement, so that a portion of each sample is visibly displayed and is immediately accessible to a retail customer. The invention includes a hanger support strip mounted on the upper convex surface of a rectilinear tubular hanger bar, with the strip defining a series of duplicte recesses for receiving and orienting the hooks of hangers.

BACKGROUND OF THE INVENTION

When carpet samples and similarly shaped items are displayed for sale, it is desirable to place a plurality of the samples in an orderly compact arrangement so that a portion of each sample is visibly displayed and wherein each sample can be conveniently taken from the display for such purposes as exposing the entire sample and for placing the sample adjacent other items whereby the customer can closely examine the individual sample, etc.

Various prior art display racks have been developed and used in the past for displaying carpet samples, etc. For example, U.S. Pat. No. 2,946,454 illustrates a carpet sample display rack wherein an inclined plate supports a plurality of carpet samples in a cascade or waterfall effect, exposing a bottom strip of each sample. In the typical cascade display each sample is connected by a hook or chain to the inclined plate and the customer lifts those samples on top of the sample desired to be exposed and if the sample is to be removed from the display, the upper samples must be lifted further so that the hooks or chains of the desired sample can be disconnected from the display. When the removed sample is to be reinserted in the display, the customer or clerk must again lift the upper samples to insert the inspected sample back into its proper position.

In other prior art carpet sample display structures a hanger support bar is supported at its ends in a horizontal attitude and carpet samples are attached to a hanger and the hanger is hung from the support bar. In some instances the support bar has protrusions extending upwardly therefrom such as shown in my U.S. Pat. No. D.247,085. The protrusions space the hangers along the length of the support bar, thereby providing some visual separation of the edges of the carpet samples. In this type arrangement the exposed edges of the carpet samples are not oriented toward the customer but are oriented toward the adjacent carpet samples, thereby failing to adequately display each sample. In other instances the hanger support bar has been oriented in an inclined attitude so that the upper edge of each sample hung from the bar is exposed over the upper edge of the sample in front of it; however, in this type arrangement a relatively small number of samples can be displayed, or if the number of samples is increased, the exposure of each sample becomes inadequate.

SUMMARY OF THE INVENTION

Briefly described, the present invention comprises a hanger support for displaying carpet samples and other items wherein each sample is hung on a hanger with a curved hook, and the hook of each hanger is placed in the recess of a hanger strip mounted on the upper surface of a hanger bar. The recesses of the hanger strip are parallel to one another and extend at an angle across the hanger strip other than at a right angle with respect to the length of the hanger strip, so that the hangers and samples are angled in a louvered arrangement. Additionally, the hanger support bar is inclined and the hanger strip is positioned slightly to one side of the upper surface of the hanger support bar so that the support areas for the curved hook of each hanger are located at the same level, thereby properly orienting the hangers and carpet strips parallel to one another. The incline of the hanger support bar and the angled relationship of the carpet samples with respect to the support bar provides a louvered arrangement both at the upper edge and at one side edge of each carpet sample, thus providing an L-shaped display of each sample.

Thus, it is an object of this invention to provide a hanger support for supporting and displaying carpet samples and the like in a compact louvered display to expose an edge portion of a plurality of the samples in an attractive, arrangement.

Another object of this invention is to provide an inexpensive and effective display structure for carpet samples and the like.

Other objects, features and advantages of the present invention will become apparent upon reading the following specification, when taken in conjunction with the accompanying drawings.

BRIEF DESCRIPTION OF THE DRAWINGS

FIG. 4 is an end cross sectional view of the hanger strip and its support bar, and a partial view of a hanger supported on the hanger strip.

FIG. 5 is an end view of the hanger strip mounted on an inclined support bar and a partial view of the hook of a hanger, with the hanger strip being improperly positioned on the hanger bar.

FIG. 6 is an end view of the hanger strip mounted on an inclined support bar, similar to FIG. 5, but illustrating the hanger strip properly oriented on the hanger bar.

DETAILED DESCRIPTION

Figure 1:
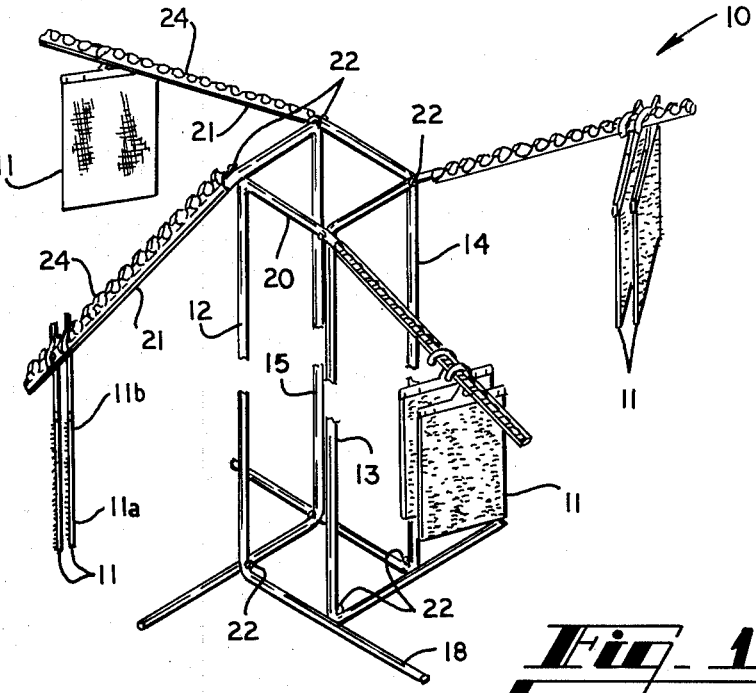
FIG. 1 is a perspective illustration of a hanger support structure for displaying carpet samples.

Referring now in more detail to the drawings, in which like numerals indicate like parts throughout the several views, FIG. 1 illustrates a carpet sample display rack 10 which supports and displays carpet samples 11 in an attractive, compact arrangement. The display rack 10 comprises four similar tubular frame elements 12, 13, 14 and 15 connected together in a framework. Each frame element 12-15 includes a rectilinear floor engaging foot 18 normally resting in a horizontal attitude on a floor surface, a rectilinear support leg 19 extending substantially perpendicular from one end of the foot and normally extending in a vertical attitude, a rectilinear upper horizontal brace 20 extending substantially perpendicular from the upper end of the leg 19 and parallel to its foot 18 and normally extending in a horizontal attitude back in the direction of the foot 18, and a rectilinear hanger arm 21 extending from the end of the upper brace in a downwardly sloped incline over foot 18. Each frame element 12–15 is joined to one another at the intersections of the their feet 18 and support legs 19, at the intersections of their support legs 19 and upper braces 20, and adjacent the intersections of the braces 20 and sloped hanger arms 21. Thus, the feet 18 radiate outwardly from the display rack at 90° intervals and the rectilinear hanger arms 21 slope downwardly from the upper portion of the display rack and project outwardly therefrom at 90° intervals thereabout. Bolts 22 rigidly connect the frame elements 12–15 together.

A hanger support strip 24 is mounted on the upper surface of each hanger arm 21. The hanger support strips 24 are shaped so that hangers 25 having upper curved hooks 26 can be mounted over the hanger arms 21 and the hangers will be supported in spaced parallel relationship with respect to one another.

As illustrated in FIG. 4, the hangers 25 comprise upper supporting hook 26, lower horizontal support bar 28 and connector tabs 29 at opposite ends of the support bar 28. A carpet sample 11 is positioned with its upper edge portion in flat abutment with the horizontal support bar 28 of a hanger 25 and the connector tabs 29 are folded down against the pile of the carpet samples in a clamping relationship, and U-shaped metal clamps 30 are inserted about the connector tabs to hold the connector tabs in closed relationship with respect to the carpet sample. Thus, the carpet sample is supported by the hanger 25 in a flat suspended configuration, with the carpet sample parallel to the plane of the hanger 25. The carpet hangers illustrated are commercially available and marked with U.S. Pat. Nos. 3,698,607 and 3,767,092.

Figure 2:
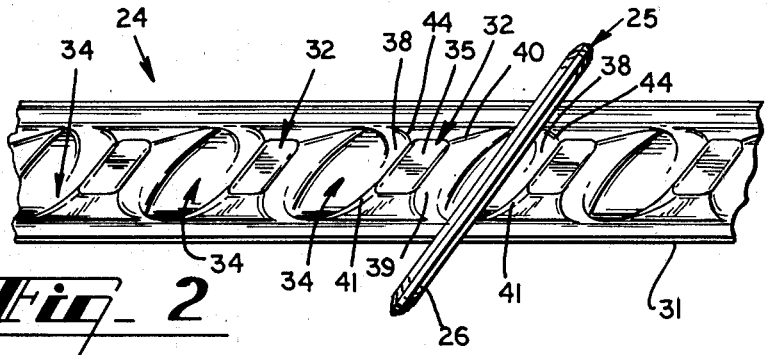
FIG. 2 is a top view of a hanger strip, showing the hook of a hanger engaging one of the recesses of the hanger strip.
Figure 3:
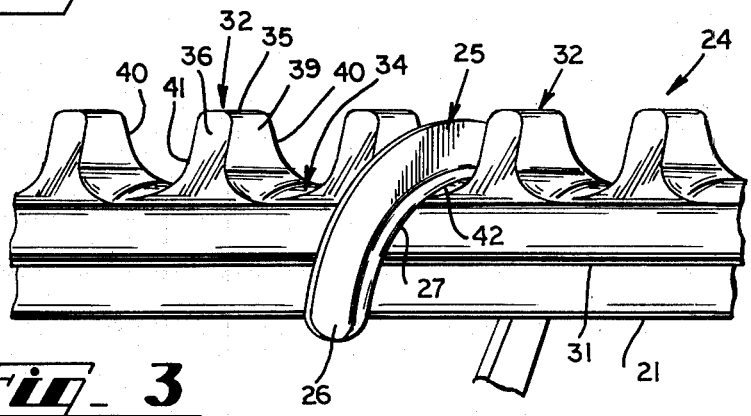
FIG. 3 is a side view of the hanger strip, illustrating the manner in which the hanger strip is mounted on a hanger support bar.

As illustrated in FIGS. 2 and 3, hanger support strip 24 comprises a unitary molded elongated strip of plastic material such as acrylonitrile butadiene styrene. The strip includes an elongated, approximately hemi-cylindrical base 31 sized and shaped to be mounted on the upper portion of the convex cylindrical outer surface of a hanger arm 21. The hanger arm and strip are illustrated in FIGS. 2, 3, and 4 as being oriented in a horizontal attitude, while these arms are illustrated in FIGS. 1 and 6 as being oriented in inclined attitudes. It should become apparent that the hanger arms 21 and its strip 24 can be oriented in either attitude.

Hanger support strip 24 further includes a series of equally spaced substantially identical protrusions 32 arranged in alignment with one another along the length of the strip 24, and a series of substantially identical recesses 34 are formed between adjacent ones of the protrusions 32. Each protrusion includes a top surface 35, approximately parallel opposed side surfaces 36 and 37 and front and rear surfaces 38 and 39. The upper portions of the front and rear surfaces 38 and 39 are approximately parallel to each other so that the upper portion of each protrusion 32 generally is parallelpiped. The lower portions of the protrusions 32 flare outwardly so as to merge into the hemi-cylindrical base 31, so that the recesses 34 are concave along the length of the strip 24 and are convex across the length of the strip. Thus, the recesses 34 are slots formed in the hanger support strip 24 and the slots extend across the length of the hanger support strip 24 and the slots are oriented at an angle other than a right angle with respect to the length of the strip 24 with all of the slots being oriented parallel with respect to one another.

As illustrated in FIG. 4, the curvature of the inner support surface 27 of hook 26 of each hanger 25 is of substantially larger radius than the curvature of the hanger arm 21 and of the approximately hemi-cylindrical bse 31 of the hanger support strip 24. However, since recesses 34 are oriented at an angle other than a right angle with respect to the length of the hanger support strip 24, the curvature of the recesses 34 along the lengths of the recesses, not at a right angle with respect to the length of the hanger support strip 24, are approximately the same as the curvature of the inner supporting surface 27 of the hooks 26 of the hangers 25. When the hooks 26 are placed in between the protrusions 32, the protrusions and their intermediate recesses 34 tend to guide the inner supporting surface 27 of the hanger hook 26 into alignment with the recess so that the supporting surface 27 of each hook tends to rest substantially in flat abutment with the rounded supporting surface of the recess. It will be noted that the relatively sharp edges 40 and 41 of the protrusions tend to merge in overlaped relationship across the length of the hanger support strip 24 and tend to guide the inner supporting surface 27 of the hook 26 of each hanger toward the bottom surface of each recess. Thus, all of the hangers 25 will be located parallel to one another when the hanger arm 21 is horizontal and when the hanger support strip 24 is mounted on the upper convex surface of the hanger arm.

It will be noted that the geometry of the hook 26 of the hangers 25 is such that the uppermost portion 42 of the inner supporting surface 27 of each hook rests against the hanger support strip 24. When the hanger arm 21 and its hanger support strip 24 are inclined in a manner illustrated in FIG. 5, the inner portion of each recess 34 of the hanger strip is tilted somewhat so that it no longer forms the lowermost supporting surface for the hooks 26 of the hangers 25. The hangers tend to ride in their recesses somewhat toward the lowermost protrusion 32 and the supporting surface 42 of the hook 26 shifts over to the sharper edge 41 of the hanger strip, so that the lower portion of the sharper edge 41 of the lower protrusion 32 tends to function as the sole support for the hanger 25. Thus, the hanger tends to swing somewhat freely about this single point of support, and the plurality of hangers 25 tend to lose their parallel orientation.

If hanger arm 21 remains in its inclined attitude but is rotated on its longitudinal axis, or if the hanger support strip 24 is rotated to one side of the upper most surface of the hanger arm 21, the obtuse edge 44 of each protrusion 32 is moved higher with respect to the acute edge 41. If the hanger support strip 24 is rotated to the proper attitude, the acute edge 41 and obtuse edge 44 of the protrusions 32 can be oriented level with each other. Since the rear surfaces of the protrusions are substantially flat, this tends to form two separate support areas 45 and 46 at the base of each protrusion 32 (FIG. 6) adjacent the rounded recess between the protrusions and the inner supporting surface 27 of each hanger becomes supported in two support areas 42A and 42B. This support arrangement tends to orient the hangers 25 parallel to the rear surfaces 39 of the protrusions 32, thus orienting all of the hangers parallel to one another and at an angle other than a right angle with respect to the length of the hanger support strip 24.

As illustrated in FIG. 1, the hanger arms 21 of the display rack 10 are sloped downwardly and the hanger support strips 24 are oriented to one side of the upper surface of the hanger arms in the manner illustrated in FIG. 6. Therefore, the carpet samples 11 hung on the display rack 10 tend to rest in a louvered arrangement with respect to their side edges 11A and with respect to their upper edges 11B, and an approximately L-shaped visual display is created for each carpet sample 11 on a hanger arm 21. If the customer wishes to remove a sample from the hanger arm, the customer merely lifts the sample and its hanger off the hanger arm and the space from which it was retrieved is maintained until the carpet sample and its hanger are replaced on the hanger arm. No manipulation of the other carpet samples is necessary to remove a sample, and when a sample is placed back on the hanger arm it immediately assumes its proper attitude which is parallel to an equally spaced from the adjacent samples.

While this invention has been described in detail with particular reference to a preferred embodiment thereof, it will be understood that variations and modifications can be effected within the spirit and scope of the invention as described herein before and as defined in the appended claims.

I claim:

1. In combination, a rectilinear hanger bar oriented in an inclined attitude, an elongated hanger strip mounted on the upper surface of said rectilinear hanger bar for supporting a plurality of hangers for carpet samples and the like from the hanger bar with the hangers each including a hook for extending over the hanger strip and the hanger bar, said hanger strip comprising an elongated molded unitary strip including a plurality of duplicate, equally spaced projections longitudinally aligned along the strip and defining a series of recesses therebetween for receiving the hooks of the hangers, said projections each including parallel front and rear surfaces extending across the length of the strip at an angle other than a right angle with respect to the length of the strip and with the front and rear surfaces of each projection oriented parallel to the front and rear surfaces of adjacent ones of the projections, said recesses between said projections each including a curved hanger support surface extending parallel to the front and rear surfaces of said projections, the projections of said hanger strip being offset from the upper surface of the tubular hanger bar at an angle sufficient to orient the ends of each recess at substantially the same level.

2. The combination of claim 1 and wherein said hanger bar has a cylindrical outer surface and wherein said hanger strip includes a bottom surface that substantially conforms to the cylindrical outer surface of said hanger bar.

3. A hanger strip for mounting on the upper surface of an inclined rectilinear tubular hanger bar for supporting a plurality of duplicate hangers each with a curved hook of a predetermined radius of curvature extending over the hanger bar, said hanger strip comprising an elongated molded unitary strip with duplicate projections equally spaced and aligned with one another along the length of said strip for extending upwardly from the hanger bar, a series of duplicate recesses extending parallel to one another across the length of said strip at an angle other than a right angle with respect to the length of said strip, with each recess defining two support areas with the support areas at opposite ends of the recess and spaced across and along the length of said strip which are engaged by the curved hooks of the hangers, said hanger strip oriented on its hanger bar so that the support areas at the opposite ends of each recess are at substantially the same level, whereby the recesses maintain the hanger hooks of the hangers hung on the hanger strip oriented parallel to one another at an angle other than a right angle with respect to the length of the hanger strip.

4. The hanger strip of claim 3 and further including a rectilinear hanger bar with a cylindrical outer surface and oriented in an inclined attitude, said hanger strip being attached to the upper surface of said hanger bar and positioned about the curved surface of said hanger bar so that the two support areas of each recess are at substantially the same level.

* * * * *